US006640085B1

(12) United States Patent
Chatzipetros et al.

(10) Patent No.: US 6,640,085 B1
(45) Date of Patent: Oct. 28, 2003

(54) ELECTRONICALLY STEERABLE ANTENNA ARRAY USING USER-SPECIFIED LOCATION DATA FOR MAXIMUM SIGNAL RECEPTION BASED ON ELEVATION ANGLE

(75) Inventors: Argyrios A. Chatzipetros, Lake Worth, FL (US); Stelios Patsiokas, Plantation, FL (US)

(73) Assignee: XM Satellite Radio Inc., Washington, DC (US)

( * ) Notice: Subject to any disclaimer, the term of this patent is extended or adjusted under 35 U.S.C. 154(b) by 0 days.

(21) Appl. No.: 09/388,371

(22) Filed: Sep. 1, 1999

(51) Int. Cl.[7] ..... H04H 1/00

(52) U.S. Cl. ..... 455/3.02; 455/429; 455/12.1; 455/345; 342/368

(58) Field of Search ..... 455/3.02, 429, 455/12.1, 550, 575, 90, 269, 272, 345, 456; 342/368, 359, 360; 343/702, 711

(56) References Cited

U.S. PATENT DOCUMENTS

| | | | | |
|---|---|---|---|---|
| 4,811,026 A | | 3/1989 | Bissett | 343/766 |
| 5,025,493 A | | 6/1991 | Cook, Jr. | 342/374 |
| 5,245,348 A | | 9/1993 | Nishikawa et al. | 342/359 |
| 5,347,286 A | | 9/1994 | Babitch | 342/359 |
| 5,349,360 A | | 9/1994 | Matsui | 342/374 |
| 5,422,648 A | | 6/1995 | Uematsu et al. | 342/359 |
| 5,471,219 A | * | 11/1995 | Rodeffer et al. | 342/359 |
| 5,583,514 A | | 12/1996 | Fulop | 342/359 |
| 5,585,804 A | | 12/1996 | Rodeffer | 342/359 |
| 5,629,709 A | | 5/1997 | Yamashita | 342/359 |
| 6,023,242 A | * | 2/2000 | Dixon | 342/359 |
| 6,195,559 B1 | * | 2/2001 | Rapeli et al. | 342/359 |
| 6,272,316 B1 | * | 8/2001 | Wiedeman et al. | 455/12.1 |
| 6,453,471 B1 | * | 9/2002 | Klosterman | 348/563 |

* cited by examiner

*Primary Examiner*—Lester G. Kincaid
*Assistant Examiner*—Ronald J. Ward
(74) *Attorney, Agent, or Firm*—Roylance, Abrams, Berdo & Goodman, LLP

(57) ABSTRACT

An apparatus and method are provided for adjusting the gain characteristics of an antenna array in accordance with elevation angle with respect to a satellite for optimum signal reception. The antenna elements of the antenna array are electronically steered in accordance with stored antenna element control data. The antenna element control data is retrieved based on the location of a mobile unit transporting the antenna and a receiver connected thereto, and on stored satellite location data. The mobile unit location data may be provided manually by a user using an input device on the receiver, or automatically by means of a GPS receiver.

6 Claims, 5 Drawing Sheets

ELECTRONICALLY STEERABLE ANTENNA ARRAY USING USER-SPECIFIED LOCATION DATA FOR MAXIMUM SIGNAL RECEPTION BASED ON ELEVATION ANGLE

CROSS REFERENCE TO RELATED APPLICATIONS

Related subject matter is disclosed and claimed in co-pending patent U.S. patent application Ser. No. 09/263,207, filed by Stelios Patsiokas on Mar. 5, 1999; in co-pending U.S. patent application Ser. No. 09/310,352, filed by Anh Nguyen et al on May 12, 1999; and in co-pending U.S. patent application Ser. No. 09/317,947 filed by Chatzipetros et al. on May 25, 1999; all of said applications being expressly incorporated herein by reference.

FIELD OF THE INVENTION

The invention relates to a antenna system for a mobile unit that allows the gain characteristics of an antenna array to be matched to the geographic location of the mobile unit, and more particularly to an antenna system which allows a mobile unit user to enter geographic information which is used for the adjustment of the antenna array gain characteristics.

BACKGROUND OF THE INVENTION

Communications systems such as satellite-to-mobile unit communications systems require a mobile unit receiver antenna that performs well along the expected satellite elevation angle range. FIG. 1 depicts a communications system 10 comprising a satellite 12 and a mobile unit 14 for illustrative purposes. If the satellite is in a geosynchronous orbit, the elevation angle changes (e.g., between 60 degrees and 21 degrees) depending on the geographic area in which the mobile unit 14 is located. If the satellite 12 operates in an elliptical orbit, as opposed to a geosynchronous orbit, the elevation angle changes in accordance with time, as well as with the geographic location of the mobile unit 14. A need exists for an antenna system which maximizes signal reception in accordance with changes in the satellite elevation angle.

An electronically steerable antenna is described in U.S. Pat. No. 5,349,360 which changes antenna operation mode (e.g., diversity mode or multiplex wave suppressing adaptive array mode), depending on whether the antenna is in an urban area or a suburban area The antenna is mounted in a vehicle. A navigation system such as a Global Positioning System (GPS) receiver or the like is used to determine the current vehicle position. Stored file structures allow for selection of one of the operating modes based on the GPS position information to adjust the antenna elements in an antenna array.

The steerable antenna described in the U.S. Pat. No. 5,349,360, however, does not adjust antenna elements to accommodate changes in satellite elevation angle and therefore maximize signal reception. Further, the steerable antenna does not adjust antenna elements in accordance with mobile unit location data provided by a user. An advantage to using location data provided by the user is the possibility of eliminating the GPS receiver to reduce the complexity and cost of a satellite-to-mobile unit communications receiver.

SUMMARY OF THE INVENTION

In accordance with the present invention, an antenna system is provided for use in a mobile unit in a satellite-to-mobile unit communications system which comprises an antenna array and an antenna array control module for controlling the gain characteristics of the antenna array in accordance with the geographic location of the mobile unit and the corresponding elevation angle between the mobile unit and the satellite.

In accordance with an aspect of the present invention, the antenna system is controlled in accordance with array patterns for maximizing signal reception when the elevation angle is either a low elevation angle or a high elevation angle.

In accordance with yet another aspect of the present invention, an array pattern for the antenna array is selected based on the geographic location of the mobile unit as provided by a user. The satellite receiver unit can be provided with user input control devices.

In accordance with still yet another aspect of the present invention, the antenna array is controlled using antenna element control data which is stored in tables that specify an antenna pattern for optimizing reception at high and low elevation angles and which is selected based on mobile unit location data.

BRIEF DESCRIPTION OF THE DRAWINGS

The various aspects, advantages and novel features of the present invention will be more readily comprehended from the following detailed description when read in conjunction with the appended drawings, in which.

Throughout the drawing figures, like reference numerals will be understood to refer to like parts and components.

DETAILED DESCRIPTION OF THE PREFERRED EMBODIMENTS

Figure 1:
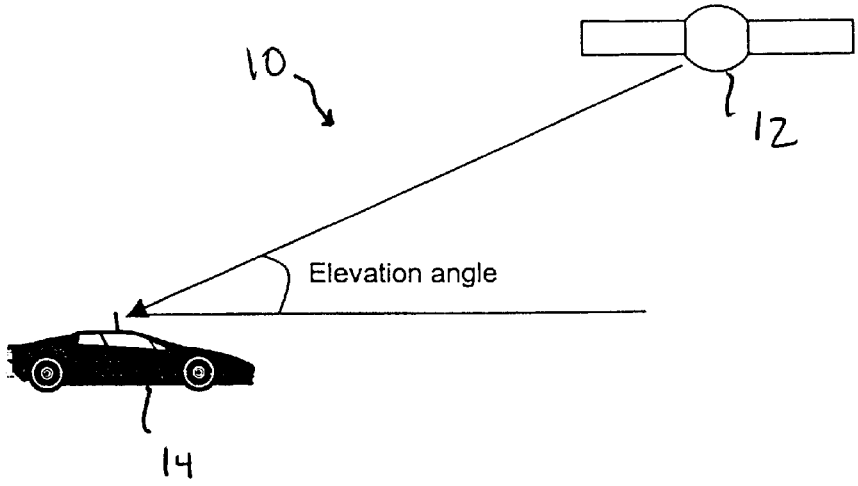
FIG. 1 illustrates a satellite-to-mobile unit communication system.
Figure 2:
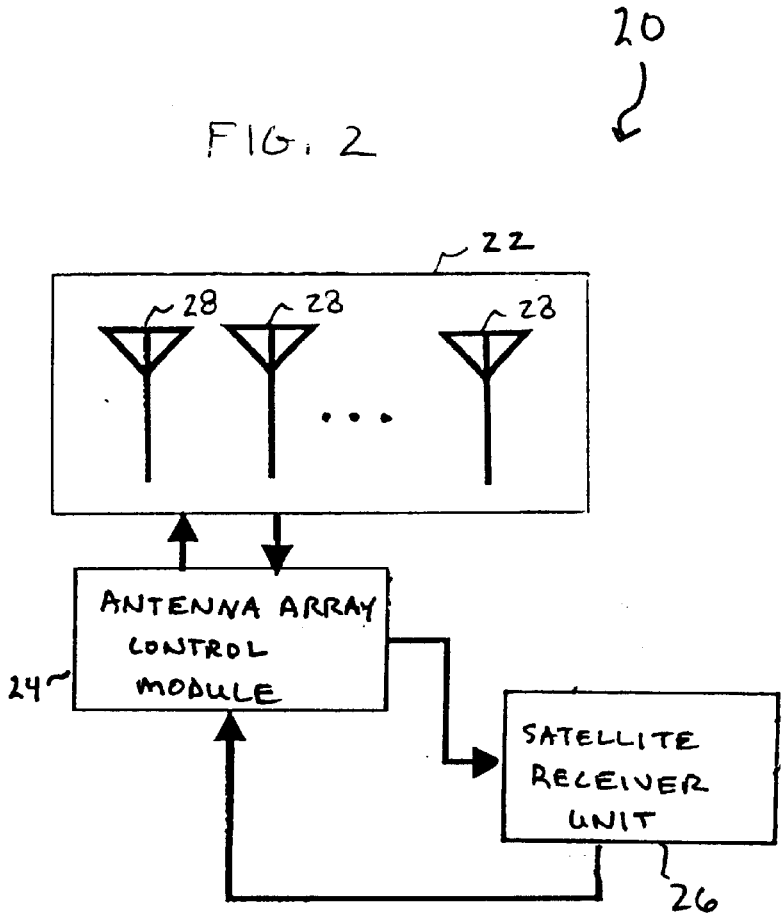
FIG. 2 is a block diagram of a receiver having an electronically steerable antenna array in accordance with an embodiment of the present invention.

FIG. 2 depicts a receiver 20 for use in a satellite-to mobile communications system 10 and constructed in accordance with the present invention. The receiver 20 comprises an antenna array 22, an antenna array control module 24 and a satellite receiver unit 26.

The antenna array 22 is preferably omnidirectional and comprises a plurality of antenna elements 28. The antenna array 2 can be a multiple element antenna, a patch antenna, a flat array antenna, a quadrifilar antenna, a phased array antenna, or the like, and is preferably configured to receive S-band radio frequency signals in the range of 2300 to 2700 MHz. An antenna array has different gain characteristics at different elevation angles. For example, the gain and axial ratio degrade at low elevation angles, resulting in a decrease in the link margin of as much as 3 decibels (dB).

In accordance with the present invention, the antenna array control module 24 is operable to electronically adjust the antenna beam via the antenna elements 28 and respective element switching devices to maintain optimum satellite signal reception at different geographic locations and therefore at different elevation angles. The operational weights of the antenna elements 28 are electronically controlled by the antenna array control module 24 in a known manner to point the directivity of the antenna array 22 toward the satellite 12. In this manner, weak signals received at various antenna elements at a particular elevation angle can be selectively suppressed via the antenna array control module 24 to obtain the most powerful received signal. Thus, receiver 20 can provide for significant link margin improvement over satellite-to-mobile receivers that do not adjust their antenna beam based on receiver location and corresponding elevation angle.

The selective adjustment of the antenna beam, in accordance with the present invention, is preferably based on information relating to the geographic location of the receiver 20 (e.g., of a vehicle having a receiver 20 installed therein) and the elevation angle, if the satellite 12 is in a geosynchronous orbit. If the satellite is in an elliptical orbit, the elevation angle is determined via satellite ephemeris data such as elevation of the satellite in relation to time. Satellite data such as the elevation can be transmitted to the receiver 20 from a base station or ground transmitter, or manually entered. As will be described in more detail below, location information can be provided to the receiver 20 automatically via a GPS receiver, for example, or manually by a user via input devices on the satellite receiver unit 26. This information is then used by the antenna array control module 24 to change the phasing of the antenna elements 28 to provide optimal performance at the current elevation angle.

Figure 3:
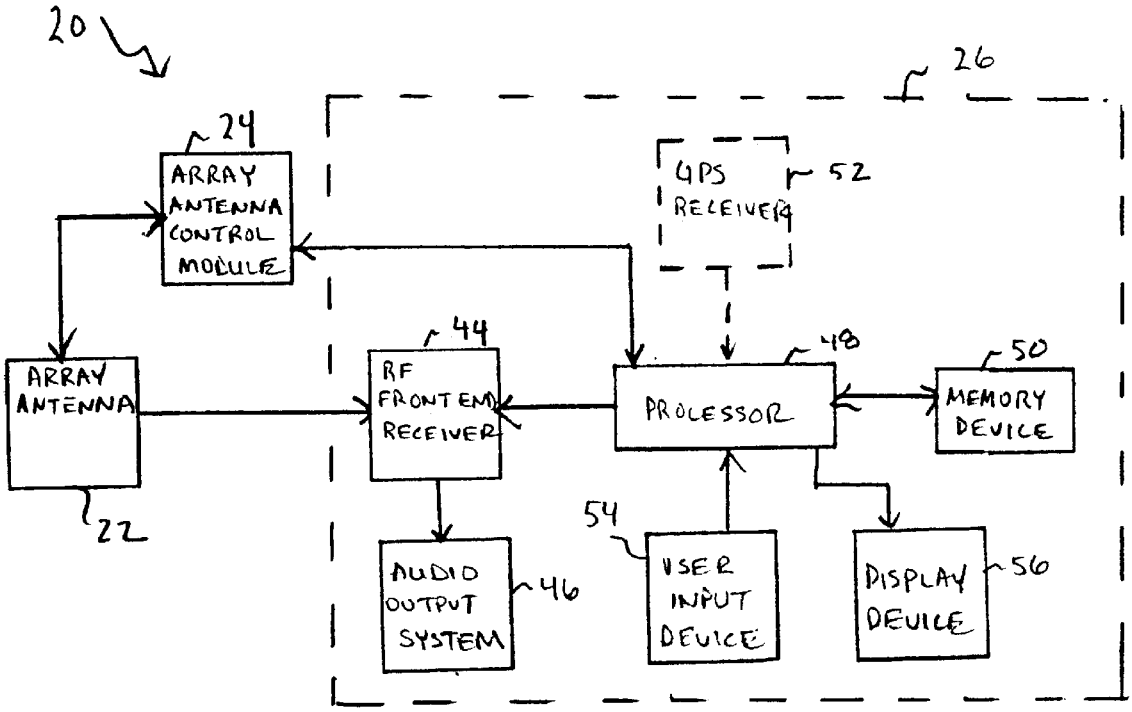
FIG. 3 is a block diagram of a satellite receiver unit having user input means and antenna control means in accordance with an embodiment of the present invention.

The receiver unit 26 is preferably an S-band digital satellite broadcast receiver and can be provided with its own audio output system 44, or connected to the existing AM/FM stereo system available in most vehicles as described in the aforementioned, commonly assigned patent application Ser. Nos. 09/263,207 and 09/310,352. Exemplary components of a receiver unit 26 are depicted in FIG. 3. The receiver unit 26 comprises a radio frequency (RF) front-end receiver 46 for receiving, demodulating and decoding the signals received via the antenna array 22 for output as analog audio signals via the audio output system 46.

The receiver unit 26 is provided with a processor 48 having a memory device 50. The memory device 50 can be used to store one or more tables which provide antenna element control data for each of a number of possible mobile unit locations to optimize signal reception for the elevation angle of the mobile unit 14 with respect to the satellite 12. Since the elevation of the satellite 12 at a given user location is known from the user's latitude if the satellite is in a geosynchronous orbit, a table of user latitudes and satellite elevations can be stored. If the satellite 12 is in an elliptical orbit, satellite ephemeris data can be stored in the tables and combined with real-time clock data The real-time clock data can be provided to the processor via a conventional clock device or an optional GPS receiver 52.

The location of the mobile unit can be represented in the tables a number of different ways for determining the elevation angle and therefore antenna array phasing for optimal reception. For example, the mobile unit locations can be listed in the tables according to coordinates as determined by a GPS receiver or other positioning system, by state name (i.e., if the present invention is deployed in the United States of America), by name of the nearest city, or by numbered zones on a map. The geographic area in which mobile units are deployed (e.g., a continent, country or other geographic area) can be divided into numbered zones by latitude with respect to the equator. The processor 48 can be programmed to receive location data relating to the mobile unit 14 via the optional GPS receiver 52 or user input device 54 and translate the location data to the state, city, zone or other means with which the tables are organized to obtain the antenna element control data therein which corresponds to the current elevation angle between the mobile unit 14 and satellite 12 for optimal reception.

Figure 4:
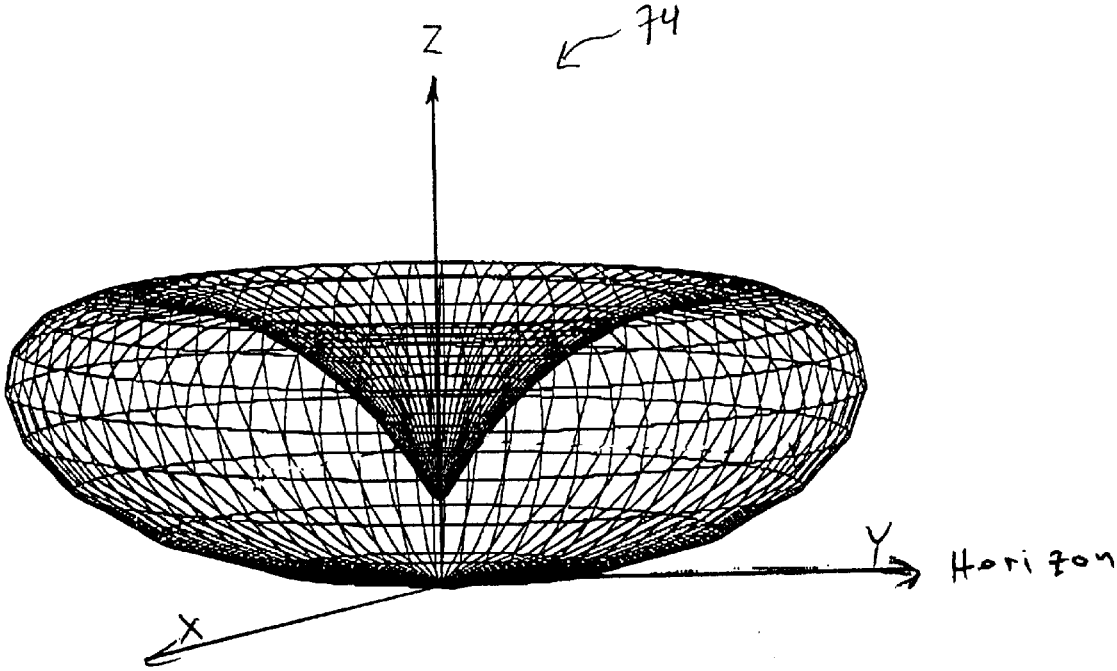
FIGS. 4 and 5 illustrate antenna patterns for low-elevation and high-elevation angles, respectively, in accordance with an embodiment of the present invention.
Figure 5:
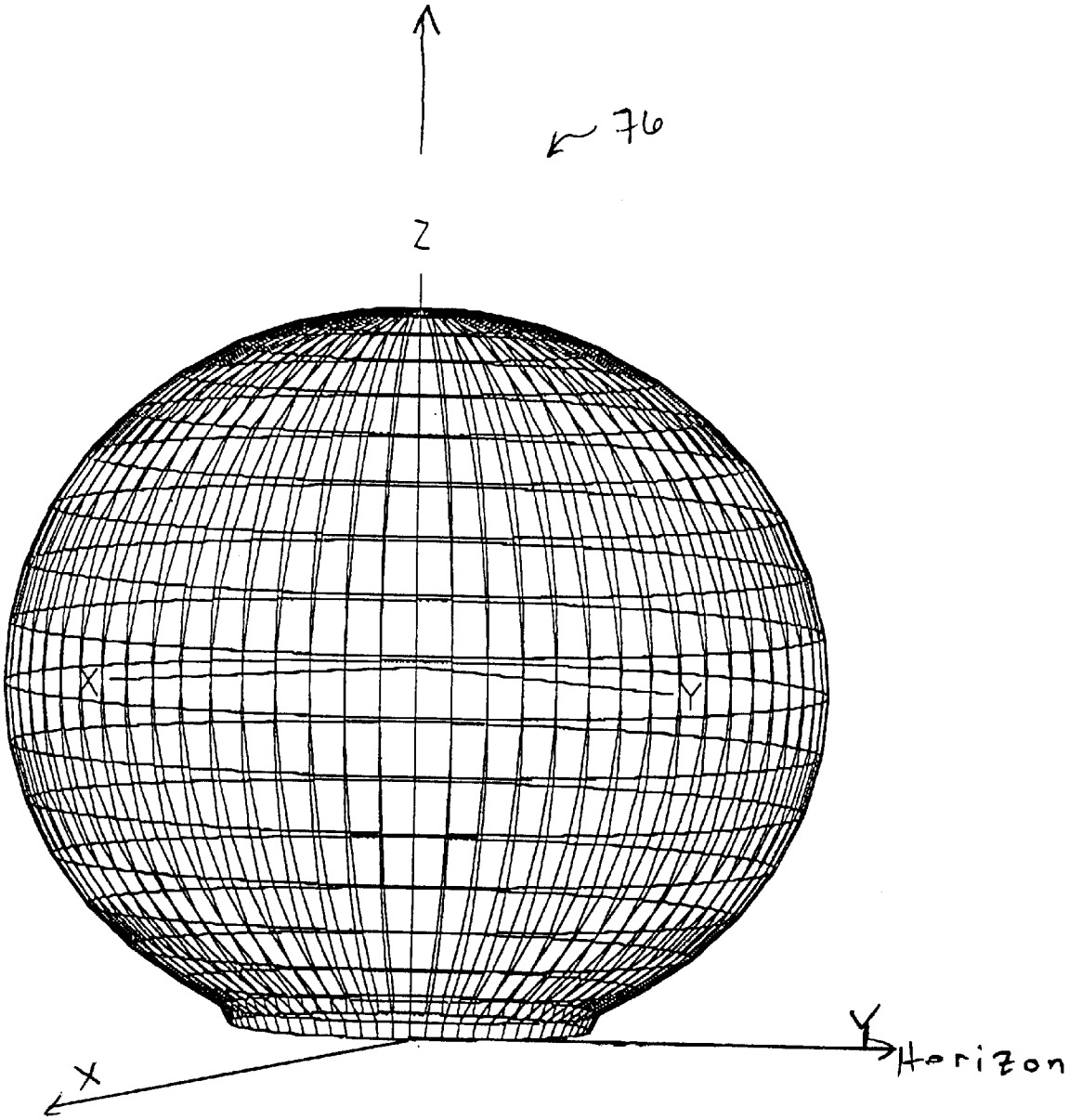

Once the mobile unit location is known, the satellite elevation angle can be determined in a conventional manner based on the current location of the satellite 12. The corresponding antenna array phasing data is then determined using the tables in accordance with the present invention. By way of an example, antenna element control data can include an antenna array pattern 74 for low-elevation angles, as depicted in FIG. 4, or an antenna array pattern 76 for high-elevation angles, as depicted in FIG. 5. Accordingly, the antenna element control data in the tables can indicate which of the two patterns illustrated in FIGS. 4 and 5 should be used based on selected ranges for high and low elevation angles. It is to be understood that more than two antenna patterns can be used. If the antenna element phasing data in the tables identifies a selected antenna pattern, the antenna array control module 24 can be programmed to interpret the table data to generate the corresponding antenna element phasing or weighting operations for the selected pattern. Alternatively, the table can identify a selected algorithm for adjusting the phasing of antenna elements or the phasing data itself, among other data options, which are then used by the antenna array control module 24 to direct the antenna beam for optimal reception.

Figure 6:
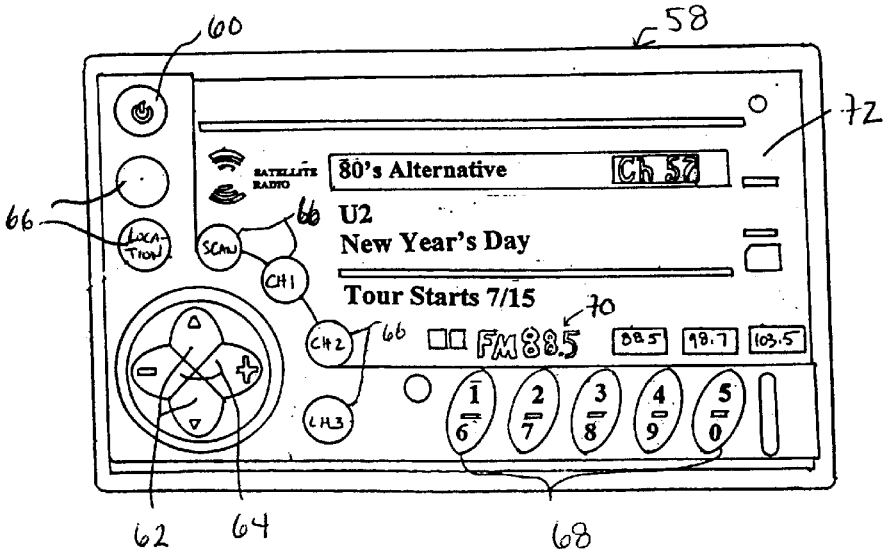
FIG. 6 is a front view of a satellite receiver unit constructed in accordance with an embodiment of the present invention.

The receiver unit 26 preferably comprises a face plate 58 comprising a display 56 and a number of dials and/or buttons, as shown in FIG. 6. For example, the face plate 58 can be provided with a power button 60 for turning the receiver unit on or off, volume control buttons 62, channel selection buttons 64, and programmable control buttons indicated generally at 66. A set of numbered buttons 68 is also provided. The display 56 can indicate an FM station 70 to which the receiver unit is tuned for output via a conventional FM stereo system, as described in the aforementioned, commonly-assigned application Ser. No. 09/263,207. Other information 72 can be displayed such as the satellite broadcast channel number (e.g., channel 57) and broadcast program data (e.g., program type, artist name, song title and any ancillary data such as tour information).

Mobile unit location data can be provided automatically by a GPS receiver 52. In accordance with an embodiment of the present invention, the user can manually provide the receiver unit 26 with mobile unit 14 location data. For example, a selected one of the programmable control buttons 66 can be depressed to commence entry of mobile unit location data. The user can then use one or more of the numbered buttons 68 to enter a number corresponding to a state, country, zone, city or other geographic location in which the mobile unit is present. A chart providing the numbers relating to respective ones of states, countries, zones, cities or other geographic locations can be provided to the user in a visual format for storage in the vehicle to refer to as needed. The chart can also be stored in the memory device 50 for viewing on the display 56 when the programmable button 66 is depressed to commence entry of mobile unit location data. Alternatively, a satellite broadcast channel can provide the chart, which can be displayed on the display 56 when the receiver unit is tuned to that channel. Thus, the chart is provided as ancillary data to an audio program so as not to interfere with a user's listening enjoyment of a satellite broadcast program. The chart can also be provided as an audio output. The number of the channel providing the chart can be indicated to the user on the display 56 when the prograrmable button 66 is depressed to commence entry of mobile unit location data. Regardless of whether the chart is broadcast and stored temporary, or maintained in the memory device 50 at all times, the chart can be displayed in a scrolling manner on the display 56.

Figure 7:
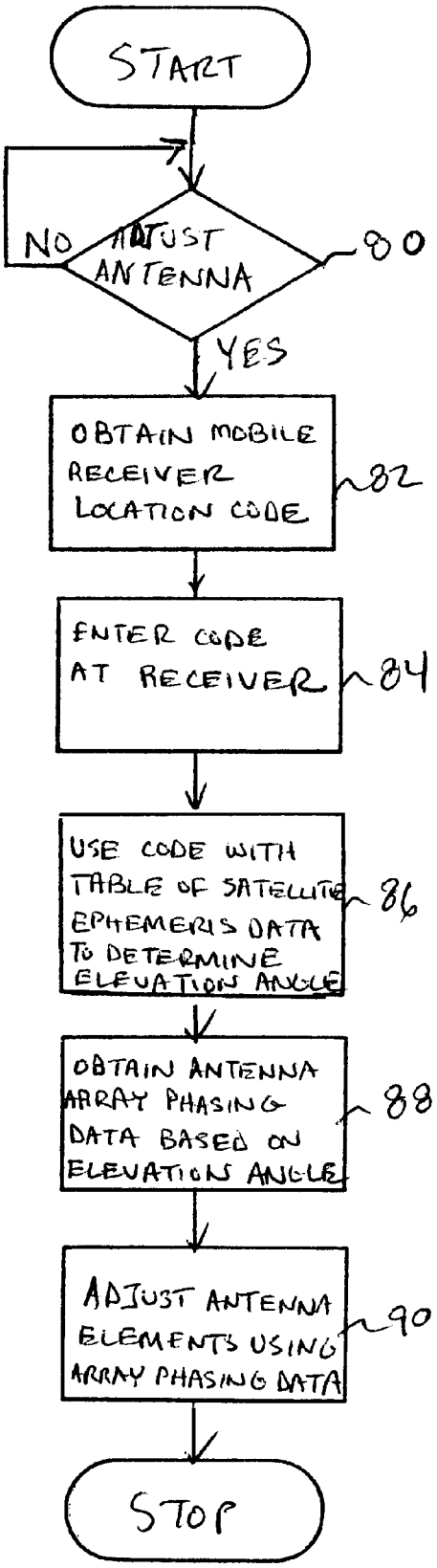
FIG. 7 is a flow chart depicting a sequence of operations for user entry of mobile unit location data and processing in accordance with an embodiment of the present invention.

With reference to the flow chart in FIG. 7, and by way of an illustrative example, a user from New York can adjust the antenna beam of the receiver 20 in his or her vehicle while traveling in Florida to improve signal reception, particularly in view of the likely difference in elevation angles between these two geographic locations. The manual method of entering mobile unit location data is described with reference to FIG. 7. It is to be understood that the location data can also be provided automatically via a GPS receiver or similar position determining device.

With reference to the decision block 80 in FIG. 7, a user selects a button 66 on the display 56 of the receiver unit 26 to indicate when an antenna array phasing adjustment is desired. The user may, for example, be experiencing reception problems such as a weak or noisy received signal. As indicated in block 82, the user consults a chart providing codes (e.g., numeric codes) corresponding to different geographic locations (e.g., state, city, zone, or other location). The chart can be provided on the display 56 or via other visual or audio output means, as described above. The user enters the code corresponding to the location of the receiver 20 to which the user is listening. The code can be entered on a designated one of the buttons provided on the face plate 58 of the receiver unit 26 (block 84).

With continued reference to FIG. 7, the processor 48 uses the code corresponding to the module unit location with other data from one or more of the tables stored in the memory device 50 (block 86). The tables provide satellite data with which to determine the elevation angle between the satellite 12 and the current location of the mobile unit 14, as indicated by the code. The data is combined with real-time clock data if the satellite 12 is in an elliptical orbit The tables also provide antenna element control data to optimize reception at different elevation angles. The antenna element control data corresponding to the determined elevation angle is provided to the antenna array control module 24 (lock 88), which in turn adjusts the gain characteristics of the antenna elements 28 accordingly (block 90).

Although the present invention has been described with reference to a preferred embodiment thereof, it will be understood that the invention is not limited to the details thereof. Various modifications and substitutions have been suggested in the foregoing description, and others will occur to those of ordinary skill in the art. All such substitutions are intended to be embraced within the scope of the invention as defined in the appended claims.

What is claimed is:

1. A method of adjusting an antenna on a radio receiver with respect to a satellite comprising the steps of:

selecting a first range of elevation angles of said satellite with respect to said radio receiver to correspond to a low elevation angle;

selecting a second range of elevation angles of said satellite with respect to said radio receiver to correspond to a high elevation angle;

selecting at least first and second antenna array patterns for providing different array phasing data to a plurality of antenna elements associated with the antenna depending on which of said first and second antenna array patterns is used to adjust said antenna, said first and second antenna array patterns being selected to optimize reception of said radio receiver when characterized, respectively, as having one of said first range of elevation angles and said second range of elevation angles;

determining if the elevation angle of said satellite with respect to said radio receiver at each of selected geographic areas in the operating area of said satellite is within said first range of elevation angles or said second range of elevation angles; and storing antenna data in a computer-readable memory device for use by said radio receiver to adjust said antenna, said antenna data relating one of said first and second antenna array patterns to each of said selected geographic areas depending on whether the elevation angle thereof is within one of said first range of elevation angles or said second range of elevation angles.

2. A method as claimed in claim 1, wherein said antenna data identifies one of said first and second antenna array patterns to use to adjust said antenna for each of said selected geographic areas.

3. A method as claimed in claim 1, further comprising the step of performing at least one of antenna element phasing operations and antenna element weighting operations corresponding to which of said first and second antenna array patterns is identified by said antenna data for the current location of said receiver.

4. A method as claimed in claim 1, wherein said antenna data identifies one of said first and second algorithms corresponding, respectively, to said first and second antenna array patterns to use to adjust said antenna for each of said selected geographic areas.

5. A method of adjusting an antenna on a radio receiver with respect to a satellite comprising the steps of:

storing selected radio receiver locations and corresponding elevation angles in a computer-readable memory device if said satellite is in a geosynchronous orbit, and storing selected radio receiver locations, corresponding elevation angles, and ephemeris data in a computer-readable memory device if said satellite is in an elliptical orbit, said ephemeris data being combinable with real-time clock data to locate said satellite with respect to said radio receiver;

storing antenna adjustment data corresponding to said elevation angles;

providing a user with a plurality of codes corresponding to different geographic locations, said plurality of codes being received at said radio receiver via said satellite and stored in said computer-readable memory device;

receiving user location data comprising one of said codes; and relating said user location data to one of said radio receiver locations to select the corresponding one of said elevation angles and said antenna adjustment data for adjusting said antenna.

6. A method of adjusting an antenna on a radio receiver with respect to a satellite comprising the steps of:

storing selected radio receiver locations and corresponding elevation angles in a computer-readable memory device if said satellite is in a geosynchronous orbit, and storing selected radio receiver locations, corresponding elevation angles, and ephemeris data in a computer-readable memory device if said satellite is in an elliptical orbit, said ephemeris data being combinable with real-time clock data to locate said satellite with respect to said radio receiver;

storing antenna adjustment data corresponding to said elevation angles;

providing a user with a plurality of codes corresponding to different geographic locations;

receiving user location data comprising one of said codes; and relating said user location data to one of said radio receiver locations to select the corresponding one of said elevation angles and said antenna adjustment data for adjusting said antenna;

wherein said satellite is operable to broadcast audio programs and said plurality of codes are transmitted to said radio receiver as ancillary data for display during playback of said audio programs.

* * * * *